United States Patent [19]

Archer

[11] 3,966,436

[45] June 29, 1976

[54] DISCHARGE ELECTRODE

[75] Inventor: William E. Archer, Huntington Beach, Calif.

[73] Assignee: Wahlco, Inc., Costa Mesa, Calif.

[22] Filed: July 8, 1974

[21] Appl. No.: 486,548

[52] U.S. Cl. ..... 55/147; 55/112; 55/150

[51] Int. Cl.[2] ..... B03C 3/41

[58] Field of Search ..... 55/150, 112, 147, 148, 55/151, 152, 153, 149

[56] References Cited

UNITED STATES PATENTS

| | | | |
|---|---|---|---|
| 1,357,201 | 10/1920 | Nesbit | 55/150 X |
| 2,244,278 | 6/1941 | White | 55/151 |
| 2,881,857 | 4/1959 | Cosby et al. | 55/147 |
| 3,483,670 | 12/1969 | Quintilian et al. | 248/58 X |
| 3,485,011 | 12/1969 | Archer et al. | 55/2 |
| 3,686,829 | 8/1972 | Stocker | 55/148 X |

FOREIGN PATENTS OR APPLICATIONS

| | | | |
|---|---|---|---|
| 341,229 | 9/1921 | Germany | 55/150 |
| 706,152 | 3/1954 | United Kingdom | 55/150 |

OTHER PUBLICATIONS

German Printed Application No. 1,076,086 printed Feb. 25, 1960, 55-148, International Class Bold, (1 page spec., 1 sheet dwg.).

*Primary Examiner*—Frank W. Lutter
*Assistant Examiner*—David L. Lacey

[57] ABSTRACT

A gas cleansing apparatus and more particularly an electrostatic precipitating apparatus having improved discharge electrode means therein.

4 Claims, 2 Drawing Figures

DISCHARGE ELECTRODE

Figure 1:
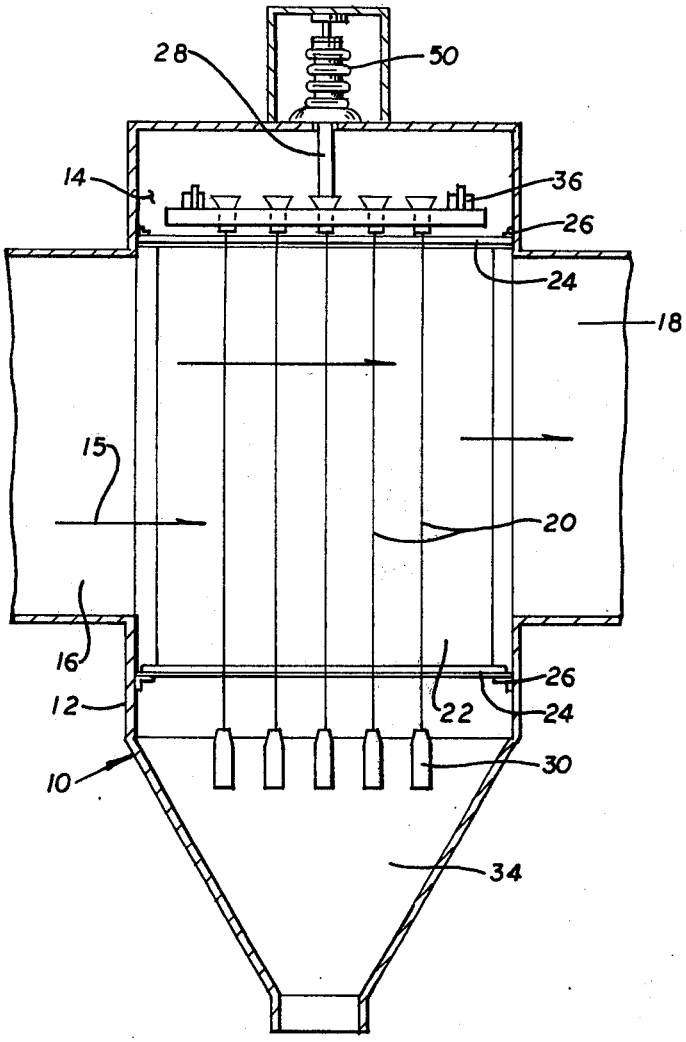

In the art of gas cleansing it is well known to provide electrostatic precipitating apparatus for the purpose of purging particulate or liquid mist contaminants from a gas stream passed therethrough. Typically such apparatus may include a plurality of discharge electrode assemblies, for example elongated discharge wires, and a cooperable plurality of collector electrode assemblies formed for example as flat plates. Precipitators of the type specified commonly are operable in accord with well known principles of electrostatics to purge a contaminant bearing gas stream passed therethrough of particulate contaminants such as fly ash by attraction of particulates to the collector electrodes prior to discharging the gas stream to the atmosphere.

It has been found that during normal operation of known electrostatic precipitators a small portion of the particulates arrested assumes a charge opposite that of the major portion of arrested particulates and is thus attracted to the discharge electrodes to accumulate thereupon rather than upon the collector electrodes. Such contaminant accumulations upon the discharge electrodes may inhibit corona discharge from the discharge electrode and otherwise interfere with an inhibit proper and efficient precipitator operation. In order to avoid such problems electrostatic precipitating apparatus has commonly included rapping devices which are operable to periodically shake the discharge electrode assemblies such as by mechanical striking thereof to dislodge tenacious particulates accumulated thereupon. Such rapping devices have met with limited success in precipitators utilizing elongated wire discharge electrodes inasmuch as the dust removing efficacy of conventional rappers relies largely upon the transverse accelerations developed thereby within the discharge electrode and upon the inertia of the accumulated particulates. Heretofore known wire discharge electrodes generally have not been responsive to conventional rapping to generate the accelerations necessary for effective dust removal, and cleansing of such electrodes has therefore been largely inadequate.

Various improvements in discharge electrode design have been proposed in the prior art to improve the efficacy of known rappers. For example, according to one proposal each discharge electrode includes two parallel wires disposed in substantially equal tension and in virtual contact with one another and joined together adjacent opposed ends thereof by means of common ferrules such that transverse motion of the wires produced by conventional rapping advantageously causes the wires to strike one another thereby inducing the transverse accelerations necessary for effective dust removal. Although such proposals generally have served the purposes intended, they have nonetheless been subject to certain undesirable deficiencies. For example, in the parallel wire electrode structure cited manufacturing problems arise due to the close tolerance on the electrode wire length which is necessary to prevent occurrence of slack in one of the two wires. Additionally the inherent mutual repulsion of the two wires in operation retards the desirable striking of the wires against one another during rapping thereby partially defeating the purpose of the design. If the two wires are mechanically interlocked as by spot welding or twisting them together intermediate their ferruled end portions to overcome the mutual repulsion thereof, electrical disturbances such as local burning or field irregularities may result.

By virtue of the present invention there is provided an improved discharge electrode assembly particularly applicable to elongated wire electrode designs and comprising an elongated, substantially straight electrode wire having an elongated helical or spiral electrode wire coaxial therewith. The discharge electrode of the present invention overcomes many of the deficiencies of prior discharge electrodes with regard to conventional rapping thereby providing improved electrode cleansing capability. Additionally, the present invention provides for a mechanically interlocked, two-wire discharge electrode which minimizes the possibility of electrical disturbance.

Figure 2:
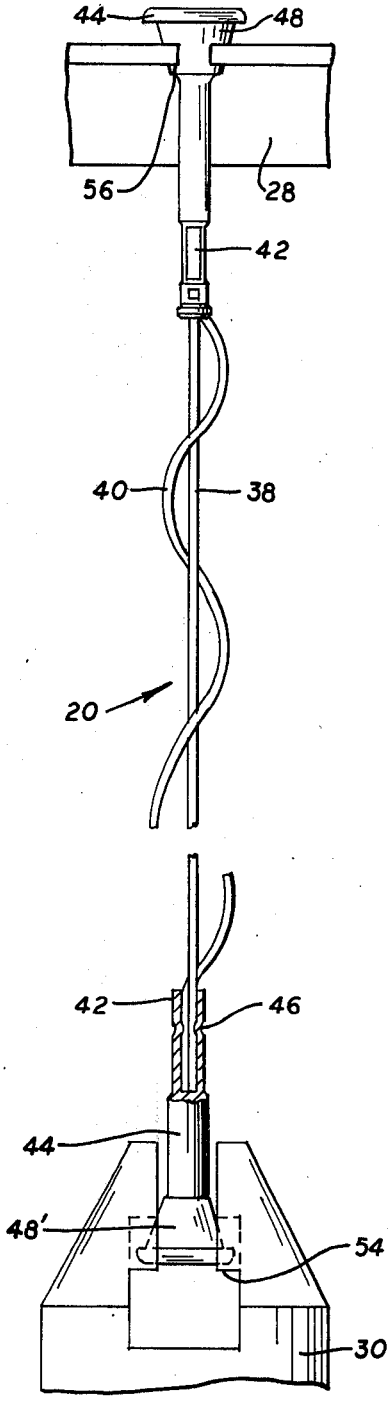

These and other objects and advantages of the present invention are more fully specified in the following description and illustrations in which:

FIG. 1 illustrates in section an electrostatic precipitating apparatus having discharge electrodes constructed in accordance with the principles of the present invention; and FIG. 2 illustrates partly in section a discharge electrode assembly of the present invention.

There is generally indicated at 10 in FIG. 1 an electrostatic precipitating apparatus including a plurality of discharge electrode assemblies 20 constructed in accord with the principles of this invention. Those versed in the art will recognize that the apparatus 10 may be adapted to purge any of various particulate or liquid mist contaminants from a gas stream passed therethrough. However, for purposes of illustration the recitation hereinbelow is directed to a simplified apparatus 10 as adapted to purge fly ash from the flue gases of fossil fuel combustion. Of course it is to be understood from the outset that such simplification is not intended to unduly limit the scope of the invention described.

Combustion of fossil fuels such as powdered coal commonly produces quantities of particulate contaminants such as finely divided fly ash which is entrained in the combustion flue gas stream. The emission of such contaminants to the atmosphere is highly undesirable, and accordingly means such as the precipitator 10 has commonly been employed to purge flue gases of such contaminants.

The apparatus 10 includes a generally rectangular housing 12 which encloses a space 14 wherein is disposed a plurality of elongated, vertically extending discharge electrode assemblies 20 and a cooperable plurality of vertically extending plate-like collector electrodes 22. The respective electrodes 20 and 22 are positioned within space 14 in any suitable arrangement such as being disposed in alternating order and laterally spaced across space 14. An inlet flue 16 and an outlet flue 18 located adjacent respective opposed side walls of housing 12 communicate with space 14 to define a gas flow path extending horizontally therebetween through the space 14 and intermediate respective electrode elements 20 and 22 as indicated by arrows 15.

The electrodes 22 are affixed and supported in the position described in any suitable manner such as by rigid members 24 suitably rigidly affixed adjacent respective uppermost and lowermost portions of each electrode 22 and rigidly affixed to side walls of housing 12 by any suitable means such as by welding thereof to angle brackets 26 rigidly carried by housing 12. The electrodes 20 are suspended from a rigid electrode support frame 28 which is rigidly carried by and electrically insulated from the housing 12 in any suitable manner as by means of a well known compression insulator 50. A respective cooperable plurality of weights 30, one weight 30 carried adjacent the lowermost end of each assembly 20, maintains the respective assemblies 20 in vertical tension.

In practice electrodes 22 are electrically connected to housing 12 which is at ground potential, and electrodes 20 are electrically isolated from housing 12 as by the insulator 50 such that a high electrical potential may be directed to assemblies 20 as by suitable conductors (not shown) connected to frame 28. The resultant potential difference between electrodes 20 and 22 effects well known electrostatic precipitation of fly ash or other particulates from a gas stream passed through space 14. As is additionally well known, collector electrodes 22 are periodically or continuously cleansed as by bathing thereof with a liquor to flush accumulated contaminants into a hopper portion 34 of housing 12 for subsequent removal to any suitable disposal facility (not shown). Fly ash accumulations upon assemblies 20 are commonly removed by means of conventional rappers 36 rigidly carried for example by frame 28 in suitable position to mechanically shake or jar assemblies 20 to dislodge contaminants therefrom.

The assemblies 20 of this invention are particularly well adapted for cleansing by conventional rapping techniques. Accordingly, as shown in FIG. 2 each of assemblies 20 comprises an elongated, substantially straight electrically conductive wire element 38 having wound thereabout and extending substantially coaxially therewith a spiraled or helically formed, electrically conductive wire element 40. The elements 38 and 40 have respective adjacent end portions thereof rigidly secured within a ferrule portion 42 of an electrically conductive shroud 44 for example by crimping of portion 42 as at 46. The crimping 46 provides both mechanically and electrically sound connection of the elements 38 and 40 within ferrules 42.

In practice the element 38 may be any suitable slender wire, for example with a diameter of approximately 0.1 inches, and the spiral element 40 may be a wire of similar diameter formed as a helix having an internal diameter of for example from 0.25 to 0.50 inches and a pitch of for example 4 to 12 inches. In assembly the full length of element 38 advantageously corresponds to an axially stretched or elongated configuration of element 40 whereby in practice the element 40 is maintained in tension in the manner of a helical spring element. Additionally, it is to be noted that a radial clearance or space is provided in assembly between the wire 38 and the helix 40 by virtue of the disparity in respective external and internal diameters thereof.

An outwardly tapering end portion 48 of the upper shroud 44 is adapted to engage a cooperable key slot 56 of the frame 28 to suspend the assembly 20 therefrom, and in an entirely similar manner a tapered end portion 48' of the lower shroud 44 is adapted to be engaged by a cooperable key slot 54 of one of the weights 30 such that the assembly 20 is retained in tension intermediate weight 30 and frame 28. The tension induced by weight 30 in the assembly 20 is transmitted intermediate respective shrouds 44 substantially entirely by the wire element 38 as mechanical tensile stress. The helical element 40 is maintained in tension in the manner of an axially stretched helical spring as hereinabove noted but does not carry any significant portion of the load of weight 30. The far greater tension in the elements 38 than in elements 40 thus induces an inherently advantageous disparity therebetween in natural frequency of mechanical vibration which effectively dampens harmonic vibrations. Additionally, the described frequency disparity together with the hereinabove noted radial clearance between elements 38 and 40 produces clashing of the elements 38 and 40 in response to conventional rapping to effectively remove accumulated particulates therefrom.

Additional advantages of the assembly 20 as described include mechanical interlocking of the elements 38 and 40 by the described intertwining thereof, which interlocking mechanism tends to minimize the possibility of undesirable electrical disturbances.

According to the foregoing recitation there is provided a discharge electrode having a twin wire configuration including a spiral or helically formed wire having another substantially straight wire extending coaxially therewithin to provide an interlocked configuration which responds advantageously to conventional rapping techniques. Furthermore the electrode of the present invention effectively dampens undesirable harmonic oscillations and minimizes electrical disturbances.

Notwithstanding the reference hereinabove to a particular embodiment of the present invention, it is to be understood that the invention may be practiced in various alternative embodiments with numerous modifications thereto without departing from the broad spirit and scope thereof. For example: spiral 40 need not extend to the full length of element 38 and need not be of a uniform internal diameter; electrodes 20 may be utilized in conjunction with variously formed collectors such as hollow pipe collector electrodes; shrouds 44 may be altered within a wide design latitude; and the like. These and other embodiments and modifications having been envisioned and anticipated it is requested that the invention be interpreted broadly and limited, only by the scope of the claims appended hereto.

What is claimed is:

1. An electrode assembly adapted to be supported within an electrostatic precipitator comprising: an elongated, substantially straight, electrically conductive electrode member; a generally helical electrically conductive electrode member having end portions; a major portion of said straight member being radially spaced from and encompassed by said helical member; securing means electrically connecting and mechanically securing said end portions of said helical member to said straight member; and weight means connected to said straight member for holding said straight member in tension; wherein only the major extent of said helical member between said end portions is free to move into and out of engagement with said straight member during normal operation in an electrostatic precipitator.

2. An electrode assembly as specified in claim 1 wherein the longitudinal axes of said members are coincident.

3. An electrode assembly as specified in claim 1 wherein said helical member has convolutions of substantially constant pitch.

4. An electrode assembly as specified in claim 3 wherein said convolutions have a pitch in the range of from 4 to 12 inches.

* * * * *